United States Patent [19]

Pujol

[11] Patent Number: 5,034,866

[45] Date of Patent: Jul. 23, 1991

[54] MULTILAMP STRIP LIGHT LUMINAIRE SYSTEM

[75] Inventor: Roger Pujol, Cross River, N.Y.

[73] Assignee: Altman Stage Lighting Co., Inc., Yonkers, N.Y.

[21] Appl. No.: 458,081

[22] Filed: Dec. 28, 1989

[51] Int. Cl.[5] ..... F21V 29/00

[52] U.S. Cl. ..... 362/240; 362/254; 362/373

[58] Field of Search ..... 362/240, 249, 235, 236, 362/237, 294, 362, 373, 277, 280, 281, 293

[56] References Cited

U.S. PATENT DOCUMENTS

| | | | |
|---|---|---|---|
| 2,307,301 | 1/1943 | Richardson | 362/373 |
| 2,307,302 | 1/1943 | Richardson | 362/373 |
| 4,511,953 | 4/1985 | Fage | 362/240 |
| 4,519,020 | 5/1985 | Little | 362/277 |
| 4,692,844 | 9/1987 | Galerne | 362/373 |
| 4,701,833 | 10/1987 | Bornhorst | 362/373 |
| 4,719,545 | 1/1988 | Cano | 362/240 |
| 4,800,475 | 1/1989 | Panagiotou | 362/373 |
| 4,839,783 | 6/1989 | Arai | 362/373 |
| 4,882,667 | 11/1989 | Skegin | 362/373 |

*Primary Examiner*—Ira S. Lazarus

*Assistant Examiner*—Richard R. Cole

*Attorney, Agent, or Firm*—Lackenbach Siegel Marzullo & Aronson

[57] ABSTRACT

A multilamp strip light luminaire system for illuminating a portion of a stage for an audience, including a housing forming a compartment having front wall defining a lamp port, a lamp positioned in the compartment having a light beam directed at the lamp port, the lamp including a dichroic reflector for passing infrared light and accompanying heat through the reflector away from the front side of the housing toward the back side of the housing, electrical wiring mounted in the housing for supplying electrical power to the lamp from a source of electrical power, vents located at first and second walls for passing heat generated by the lamp within the housing to the atmosphere, a rear vent located at the rear wall of the housing for passing heat passed by the lamp toward the back side of the housing from the housing to the atmosphere, and a baffle within the housing for blocking passage of light leaking from the lamp to the rear vent. A channel formed in the housing containing a portion of the electrical wiring, so that the electrical wiring is substantially isolated from the heat generated in the housing by the lamp.

24 Claims, 6 Drawing Sheets

MULTILAMP STRIP LIGHT LUMINAIRE SYSTEM

FIELD OF THE INVENTION

This invention relates generally to the area of stage light luminaires and more specifically to multilamp narrow luminaires.

BACKGROUND OF THE INVENTION

A strip light is a multilamp narrow luminaire used in the field of stage lighting for use on closed space battens or in tight spaces where a general wash of light from either the top, bottom, or side of the stage area or a combination of them is desired.

Each lamp in a strip light generates considerable heat that in the present art of strip lighting is vented through top and bottom openings that are partly covered with light shields to block light from passing through the openings. Light leakage from the strip light is to be avoided since the front of the strip light faces the area to be illuminated and the rear of the strip light faces and is visible to the audience and the top and bottom sides of the strip light are visible to some degree to the audience. These top and bottom openings, or vents, because of their limited areas are able to pass only a relatively small amount of the heat generated by a lamp, especially since the vent light shields tend to further reduce the passing of heat. The buildup of heat within the luminaire over time eventually overheats a portion of electrical wiring mounted in the strip light causing meltdown and failure of the electrical circuit.

Accordingly, it is an object of this application to provide a multilamp strip light system which vents the strip light of heat to the degree that electrical circuit failure because of overheating of the interior of the strip light is eliminated.

It is a further object of this application to provide a multilamp strip light system which both vents the strip light of heat in rear areas of the strip light directly facing the audience and also prevents the passage of light.

In accordance with the above objects and others which will become apparent hereinafter, there is provided a multilamp strip light luminaire system, including a housing forming a compartment having front wall defining a lamp port, lamp means positioned in the compartment having a light beam directed at the lamp port, the lamp means including a dichroic reflector for passing infrared light and accompanying heat through the reflector away from the front side of the housing toward the back side of the housing, electrical wiring mounted in the housing for supplying electrical power to the lamp means from a source of electrical power, vent means located at first and second walls for passing heat generated by the lamp mans within the housing to the atmosphere, rear vent means located at the rear wall of the housing for passing heat passed by the lamp means toward the back side of the housing from the housing to the atmosphere, and baffle means within the housing for blocking passage of light leaking from the lamp means to the rear vent means. A channel formed in the housing containing a portion of the electrical wiring, so that the electrical wiring is substantially isolated from the heat generated in the housing by the lamp.

The present invention will be better understood and the objects and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof. Other embodiments or modifications may be suggested to those having the benefit of the teachings herein, and such other embodiments or modifications are intended to be reserved especially as they fall within the scope and spirit of the subjoined claims.

DETAILED DESCRIPTION OF THE PREFERRED EMBODIMENT

Figure 1:
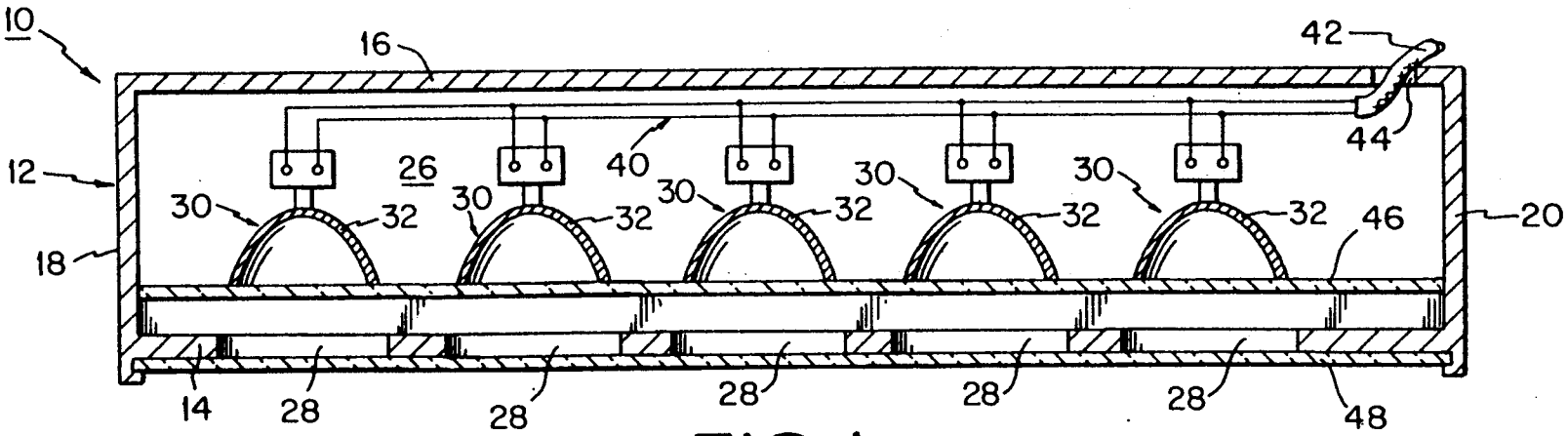
FIG. 1 PRIOR ART
FIG. 1 is a schematic top sectional view of a prior art multilamp strip light luminaire.

Reference is now made specifically to the drawings in which identical or similar parts are designated by the same reference numerals throughout.

Figure 2:
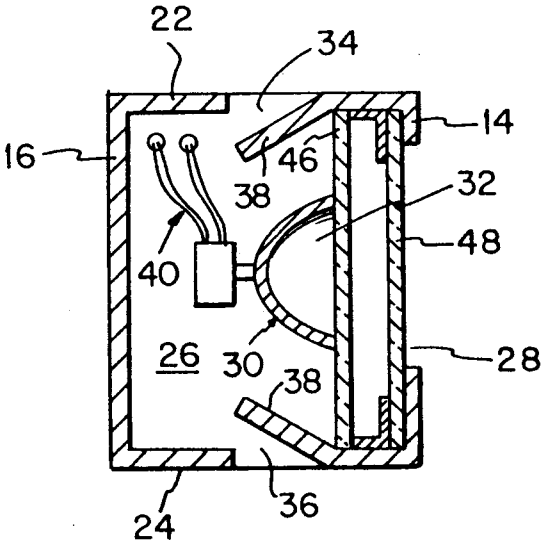
FIG. 2 PRIOR ART
FIG. 2 is a schematic side sectional view of the prior art multilamp strip light luminaire shown in FIG. 1.

A prior art multilamp strip light luminaire 10 is schematically illustrated in FIGS. 1 and 2. Luminaire 10 includes an elongated metal housing 12 having opposed front and rear walls 14 and 16, respectively, left and right side walls 18 and 20, respectively, and top and bottom walls 22 and 24, respectively, which define an elongated volume 26. Front wall 14 defines five equally spaced lamp ports 28. Five lamps 30 are positioned in volume 26 with each lamp 30 set in alignment with a lamp port 28 through which the lamp beams pass onto the area being illuminated. Mounting fixtures and and electrical connectors are provided for each lamp 32. Each lamp 30 is provided with an aluminum reflector 30. A number of top and bottom openings 34 and 36 that are partly covered with interior light shields, or panels, 38 to block light beams from passing through openings 34 and 36 so as to isolate the light from being seen by the audience behind rear wall 16. Lamps 30 are connected in parallel by electrical wiring 40 mounted in volume 26 along rear wall 16 to an electrical power cord 42 that passes through an exit port 44 in rear wall 16 near right side wall 20 and is connected to a source of electrical power. A safety screen or safety glass 46 extends across the front of lamps 30. A changeable filter 48 extends across the front of lamp ports 28.

Figure 3:
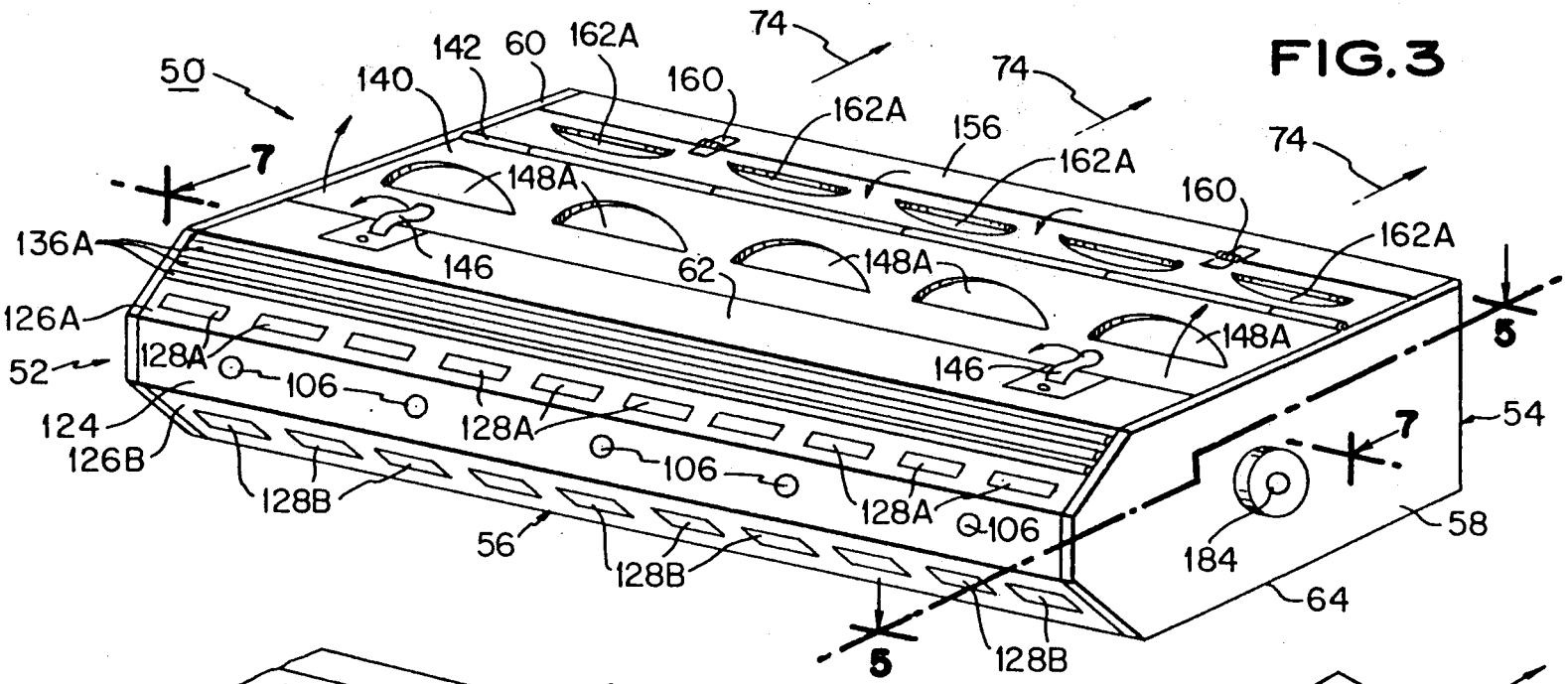
FIG. 3 is a perspective view of a multilamp strip light luminaire in accordance with the present invention.

An inventive multilamp strip light luminaire 50 for illuminating a portion of a stage or such area for an audience is illustrated in FIGS. 3–12. FIG. 3 in particular shows an elongated frame, or housing, 52 made of a material such as extruded aluminum which has opposed front and rear walls 54 and 56, opposed left and right end walls 58 and 60 described as seen facing front wall 54, and opposed top and bottom walls 62 and 64 all of which define a rectangular parallelepiped compartment 66. As illustrated in the frontal view of FIG. 4, luminaire 50 includes ten lamp units 68 positioned apart at equal intervals in lamp sets 70 of two lamp units 68 each as will be described in detail later. Front wall 54 defines five lamp ports 72. Each lamp set 70 has two lamp units 68 directing light beams 74 at a lamp port 72 through which light beams 74 (seen in FIG. 4) pass to illuminate the portion of the stage or other such area which is viewed by an audience. An internal support wall 76 spaced from and lateral to front wall 54 extending between top and bottom walls 62 and 64 and between left and right end walls 58 and 60 defines a circular light beam aperture 78 in front of each lamp unit 68 so that light beams 74 pass through circular apertures 78. A safety screen 80 held in position by a mounting wall 81, also shown in FIG. 8, which is positioned in front of each lamp unit 68 across each circular aperture 78 directly behind support wall 76. Safety screen 80 can alternatively be safety glass. A light treatment member such as filter 82A or light filters 82A and 82B, or alternatively light diffusers, in combination are mounted in adjacent filter frames 84A and 84B, respectively, which are removably mounted in filter frame mounting slots 86A and 86B, respectively, which are connected to front wall 54 at the opposite vertical side edges of each lamp port 72 so as to completely cover each lamp port 72. Filters 82A and 82B can transmit various colors in a manner known in the art. The second and third lamp ports 72 counted from the left facing housing 52 have one filter 82A, while the remaining lamp ports 72 have two filters 82A and 82B. Filter frames 84A and 84B along with filters 82A and 82B can be lifted from frame slots 86A and 86B and filters 82A and 82B removed from the filter frames and replaced with other filters which are then positioned in front of the selected lamp port 72.

Five subcompartments 88 are formed in housing 52 by four vertical side walls 90 between and lateral to left and right end walls 58 and 60 and extending between top and bottom walls 62 and 64 and between front wall 54 and support wall 76. Side walls 90 are positioned between lamp sets 70 so that each subcompartment 88 passes light from one lamp set 70 through a lamp port 72. Subcompartments 88 are isolated from one another so as to separate different one colored lights emanating from adjacent subcompartments. For example, if a filter 82A is blue in one subcompartment 88 and another filter 82A is red in an adjacent subcompartment 88, the two colors would pass from the luminaire relatively unmixed. Without subcompartments 88, the light from the two different filters would bleed together at the edges and produce a purple light.

Figure 6:
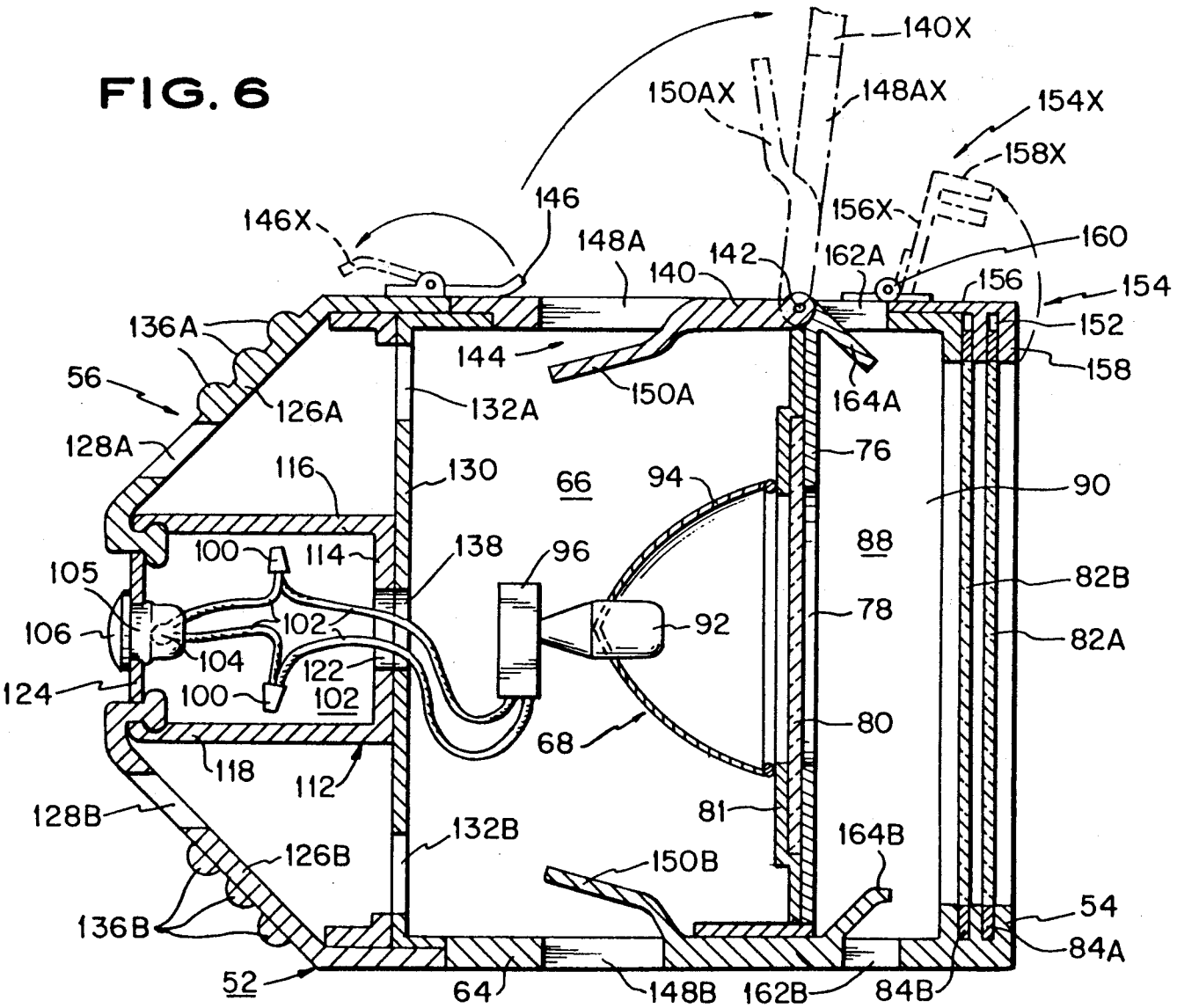
FIG. 6 is a side sectional view taken through plane 6—6 in FIG. 4.

FIG. 6 illustrates a sectional view taken through housing 52 of one lamp unit 68, which includes a lamp 92, and a parabolic lamp reflector 94. An electrical connector 96 into which lamp 92 is plugged by a two-pin prong into mating receptacles in electrical connector 96 is held in position by lamp unit 94, which in turn in removably mounted into a lamp socket 98, the latter illustrated in FIG. 8. Lamp reflector 94 is a dichroic reflector for passing infrared light and accompanying heat through reflector 94 away from the front side of housing 52, that is, away from subcompartment 88 and back into main compartment 66.

An electrical circuit for supplying electrical power to lamp 92 includes input and output electrical conductors 100 in turn electrically connected in parallel to series electrical wiring 102 that is turn is connected to electrical connectors 96. Lamp sets 70 are electrically connected by the same series electrical wiring 102 which nonremovably joins electrical connectors 96. Wiring 102 also connects one electrical connector 96 of each lamp set 70 to a neon indicator lamp 104 positioned in an electrical mounting device 105 set in rear wall 56. Five equally spaced neon indicator lamps 104 pass light though glass light covers 106 that extend outwardly from rear wall 56. Because series wiring 102 connects neon indicator lamps 104 and electrical connectors 96 in series, when a lamp 92 of a lamp set 70 fails, the neon indicator lamp 104 associated with that particular lamp set goes out. An observer at the rear of luminaire 10 can see that particular indicator lamp failure as an indication of a lamp unit 68 failure at a particular lamp set 70. Input and output conductors 100 extend between left and right end walls 58 and 60 and are connected in parallel to series wiring 102 for each lamp set 70. Input and output conductors 100 are connected to a power cord 108 which passes through an exit port 110 defined in rear wall 56 proximate to right side wall 60 and then to a source of electrical power.

As best seen in FIG. 6, a U-shaped inner wall 112 in housing 52 that includes a wall portion 114 extends vertically, that is, is lateral to front wall 54, between left and right end walls 58 and 60 and that further includes opposed top and bottom wall portions 116 and 118, respectively, that are connected to the midportion of rear wall 56. Wall portions 114, 116, and 118 together with rear wall 56 form a wiring channel 120 that is isolated from compartment 66. Vertical wall portion 114 defines five channel wiring ports 122 proximate to each of the five lamp sets 70. Electrical wiring 102 extends from electrical connectors 96 through channel wiring ports 122 into wiring channel 120. Electrical conductors 100 lie along the length of wiring channel 120 and as previously stated electrically connect in parallel to electrical wiring 102 and to power cord 108. Thus, most of the electrical wiring, particularly electrical conductors 100, is substantially isolated from the heat generated within housing 52 and particularly compartment 66 by lamp units 68.

Rear wall 52 includes a rear wall portion 124 which is vertical, that is lateral to front wall 54, and two angled top and bottom rear wall portions 126A and 126B, which are connected to the upper and lower edges of rear wall portion 124 and extend at equal angles therefrom forwardly relative to front wall 54 for connection at top and bottom walls 62 and 64, respectively. Ten rectangular upper and ten lower rear vents 128A and 128B, respectively defined by top and bottom rear wall portions 126A and 126B, respectively, are located at equal intervals between left and right end walls 58 and 60. Rear vents 128A and 128B pass heat generated by lamp units 68 from compartment 66 to the atmosphere.

A baffle wall 130 within housing 52 is oriented vertically, that is lateral to front wall 54, adjacent to wall portion 114 extending between top and bottom walls 62 and 64 and between left and right end walls 58 and 60 defines ten equally positioned upper and ten lower rectangular inner vents 132A and 132B, respectively, which are spaced at equal intervals between left and right end walls 58 and 60 proximate to the inner surfaces of top and bottom walls 62 and 64, respectively. Inner vents 132A and 132B are sufficiently large to pass heat generated in compartment 66 to upper and lower outer vents 128A and 128B, respectively. Inner vents 132A and 132B are so positioned relative to upper and lower vents 128A and 128B, respectively, that light leaking from the rear surfaces of reflectors 94 of lamps 92 are blocked by light baffle wall 130 and pass through inner vents 132A and 132B to the inner surfaces of angled rear wall portions 126A and 126B so that the light beams are substantially directed away from outer vents 128A and 128B and so are not seen by an audience opposite rear wall 56. The inner surface of angled rear wall portions 126A and 126B can optionally be covered with non-reflective heat absorbent paint. Three upper and three lower heat-radiating fins 136A and 136B, respectively, that protrude outwardly from the outer surfaces of upper and lower angled rear wall portions 126A and 126B between left and right side walls 58 and 60 pass absorbed and contained heat contained into the atmosphere. Five circular baffle wall wiring ports 138 are aligned with the five circular channel wiring ports 122 described previously with electrical wiring 122 passing through ports 138 and ports 122 to wiring channel 120.

An access door 140 to compartment 66 has a forward portion rotatably connected to top wall 62 by a hinge 142 that extends between left and right side walls 58 and 60 lateral to front wall 54. Access door 140 is rotatably movable about hinge 142 between open and closed positions, In the open position access door 140 opens an access aperture defined by top wall 62 indicated as access aperture 144 in FIG. 6, which allows access to compartment 66. In the closed position access door 140 extends across access aperture 144 and becomes a part of top wall 62. The rearward portion of access door 140 is held in a position by a pair of toggle latches 146, which are secured to top wall 62. FIGS. 3 and 6 illustrate access door 140 in a closed position. Access door 140 is shown in its open position in FIG. 3 by phantom line indicated by numeral 140A with toggle latches in a raised position as indicated by numeral 146X likewise shown in phantom line.

Five upper and five lower vent passages 148A and 148B, respectively, are located in top and bottom walls 62 and 64 spaced at equal intervals between left and right side walls 58 and 60 for the purpose of passing heat in compartment 66 to the atmosphere. Each vent passage 148A and 148B is partially shielded by an upper and a lower vent panel 150A and 150B, respectively, connected at their forward ends to top and bottom walls 62 and 64, respectively, and extending inwardly into compartment 66. Panels 150A and 150B block any light leaking into compartment 66 from lamps 92 from escaping through vent passages 148A and 148B and being seen by an audience facing rear wall 56 of luminaire 10 during a performance. Upper vent passages 148A are in fact defined by access door 140, which, as noted above, acts as a part of top wall 62 when in a closed position.

Top wall 62 defines a filter access slot 152 between front wall 5 and left and right end walls 58 and 60 above filter frame mounting slots 86A and 86B. A filter cover 154 for retaining filters 82a and 82B includes a first cover portion 156 that is adapted to overlie slot 152 and a second cover portion 158 that is transverse to first cover portion 156 and is adapted to overlie the upper part of front wall 54. Two clamps 160 are connected to top wall 62 and to the top surface of first cover portion 158 by clamp hinges. Each clamp 160 includes an axis about which is positioned a torsion spring which biases the hinge connected to first cover portion 156 downwardly so that filter cover 154 is thus normally biased downwardly over filter access slot 152. Filter access cover 154 is movable between closed and open positions, wherein in the closed position filter access cover 154 covers filter access slot 152 and in the open position is manually rotated about filter access slot 152 to a position spaced from filter access slot 152 at which open position filter access cover 154 must be manually held since the bias force of the torsion spring is greater when filter access cover 154 is in the open position than the closed position. The open position of filter access cover 154 is indicated in phantom line by numeral 154X.

Figure 7:
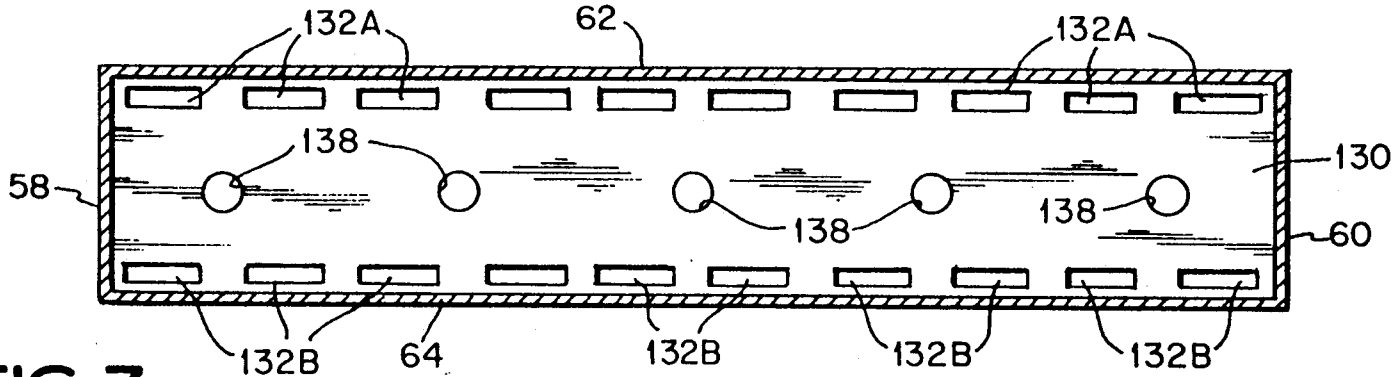
FIG. 7 is a sectional front view of the light baffle wall taken through plane 7—7 of FIG. 3.

As illustrated in FIG. 7, five upper and lower vent passages 162A and 162B each open to one subcompartment 88 defined in upper and lower walls 62 and 64, respectively, spaced at equal intervals between left and right side walls 58 and 60 for the purpose of passing heat in subcompartments 88 to the atmosphere. Each vent passage 162A and 1628B is partially shielded by an upper and a lower vent panel 164A and 164B, respectively, connected at their rearward ends to top and bottom walls 62 and 64, respectively, and extending inwardly into a subcompartment 88. Panels 164A and 164B block light from lamps 92 from escaping through vent passages 162A and 162B and being seen by an audience facing rear wall 56 of luminaire 10 during a performance.

Figure 8:
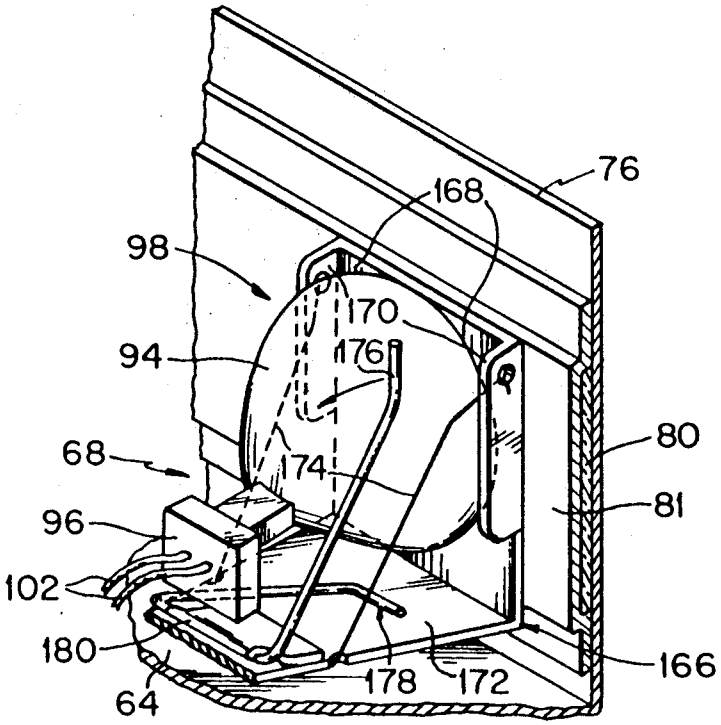
FIG. 8 is an isolated view of a single lamp mounted in a lamp socket including a release mechanism.

As illustrated in FIG. 8 ten metal lampholders 166 of a type known in the art are mounted in compartment 66 particularly to mounting wall 81 for holding the ten lamp units 68 in an operative stationary position. Lampholders 166 includes a mounting piece that in turn includes a front wall 168 secured to mounting wall 81, opposed vertical side flanges 170 for holding the forward circular side of each reflector 94, a bottom wall 172, and a partial rear wall 174. Lampholders 166 also include a pair of opposed biasable spring wires 174 which are secured at their ends to the mounting piece at flanges 170 and bottom wall 172. Lampholders 166 define the lamp socket 98 mentioned previously that holds reflector 94 in position. Biasable wires 174 are forced apart when reflector 94 is pushed into or removed from lampholder socket 98, and when reflector 94 is in lampholder socket 98 act by biasable restraint to assist in keeping lamp unit 68 in position in the socket. In addition, lamp unit unit 68 has two prongs that are mounted in two receptacles in electrical connector 96 so that electrical connector 96 is likewise secured. In the event reflector 94 is shaken from lampholder socket 98 during transportation, for instance, electrical connector 96 would hold lamp unit 68 from being moved around compartment 66 since electrical connector 96 is permanently connected to electrical wires 102. Each lamp unit 68 movable between a mounted position in lampholder socket 98 with lamp unit 68 being in an operative position when positioned in lampholder socket 98 and in a demounted position when removed from lampholder socket 98. Reflector 94 can be forced from lampholder socket 98 by a lamp releasing lever mechanism which includes a lever arm 176 connected to a prying bar 178 positioned under reflector 94 an connected to bottom wall 172 of each lampholder 166 by a pivot arm 180. When lever arm 176 is pulled, pivot arm 180 is rotated so that prying bar 178 is levered against the bottom of reflector 94 so as to force reflector 94 from lampholder socket 98.

Figure 9:
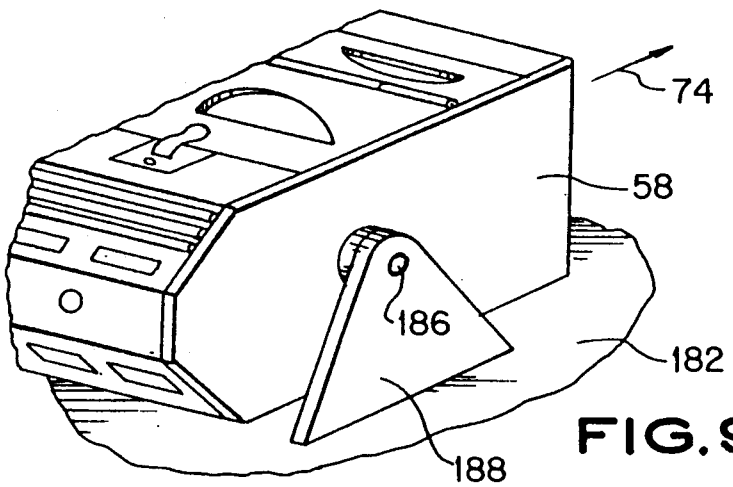
FIG. 9 is a partial perspective view of the strip light luminaire shown in FIG. 3 mounted in a generally horizontal position.
Figure 4:
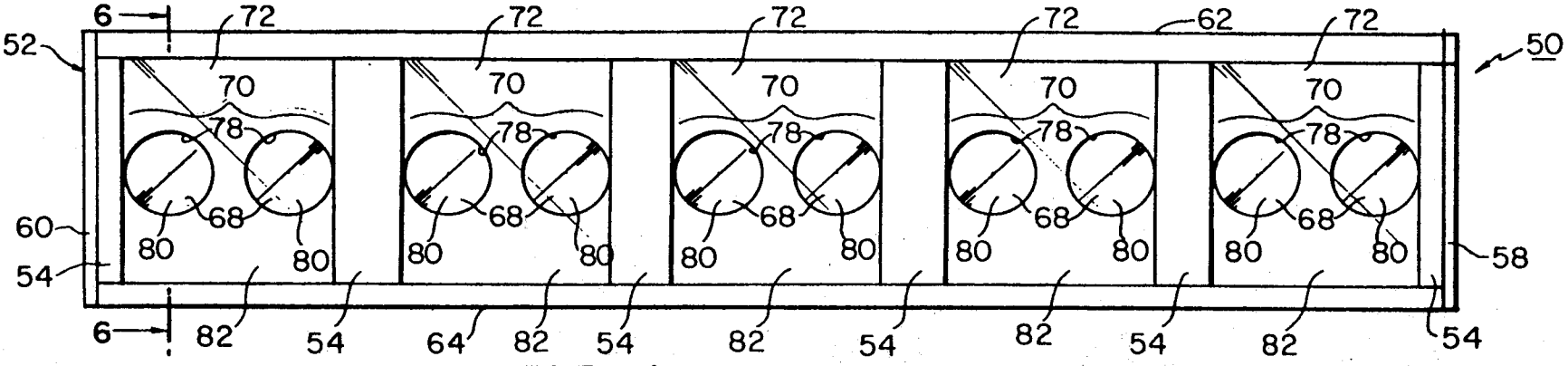
FIG. 4 is a frontal elevational view of the multilamp strip light luminaire taken through plane 4—4 taken in FIG. 3.
Figure 5:
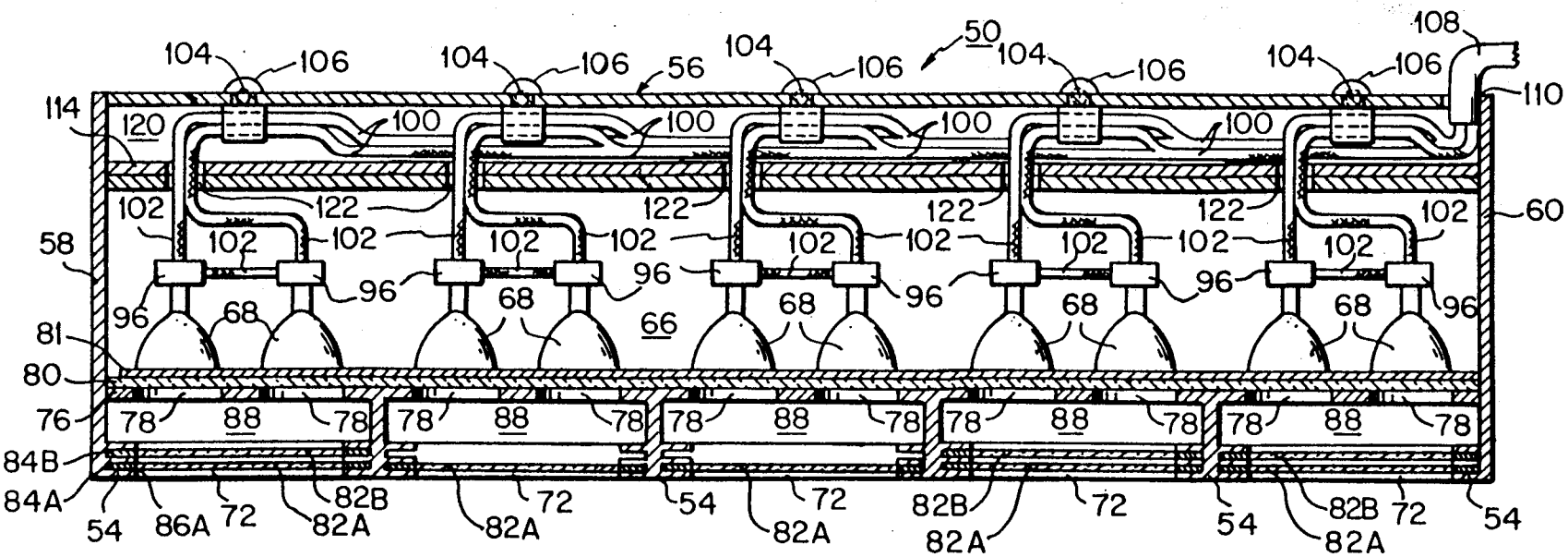
FIG. 5 is sectional view taken through plane 5—5 in FIG. 3.

FIG. 9 illustrates strip light luminaire system 10 positioned horizontally on a flat surface 182. A pair of threaded bores 184 formed in left and right end walls 58 and 60 are adapted to receive threaded trunnions, or pivots, 186 in turn mounted to triangular feet 188 which rest on surface 182.

Figure 10:
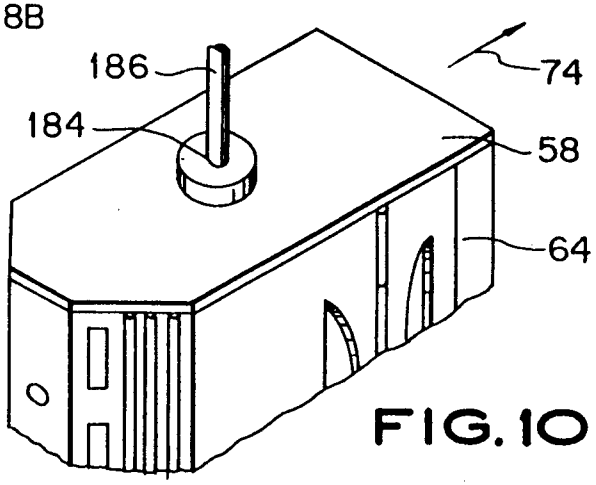
FIG. 10 is a partial perspective view of of the strip light luminaire shown in FIG. 3 mounted in a vertical position.

FIG. 10 illustrates strip light luminaire system 10 positioned vertically. Pivots 186 are connected to vertical cables 190 which are connected to hooks (not shown) hung from a horizontal support (not shown).

Figure 11:
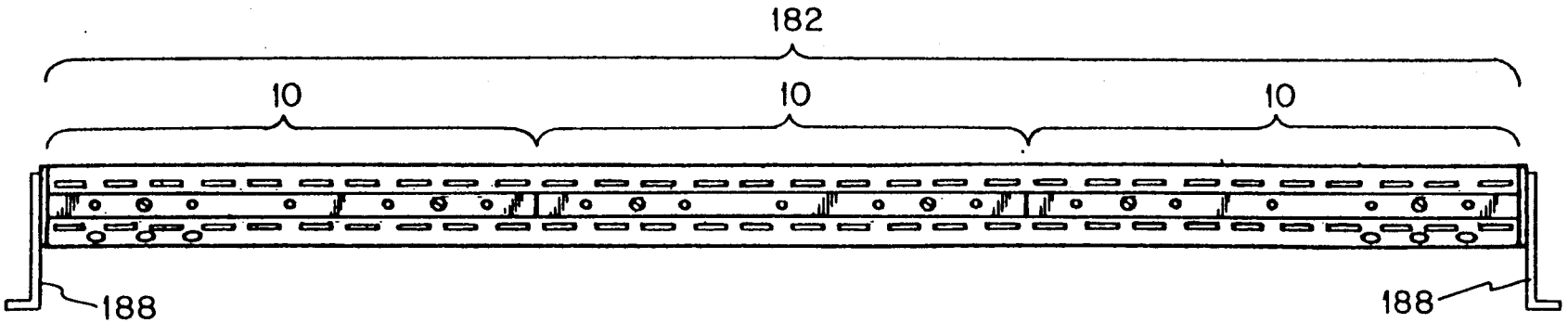
FIG. 11 is a front view of three strip light luminaires each of the type shown in FIG. 3 mounted in a horizontal position.
Figure 12:
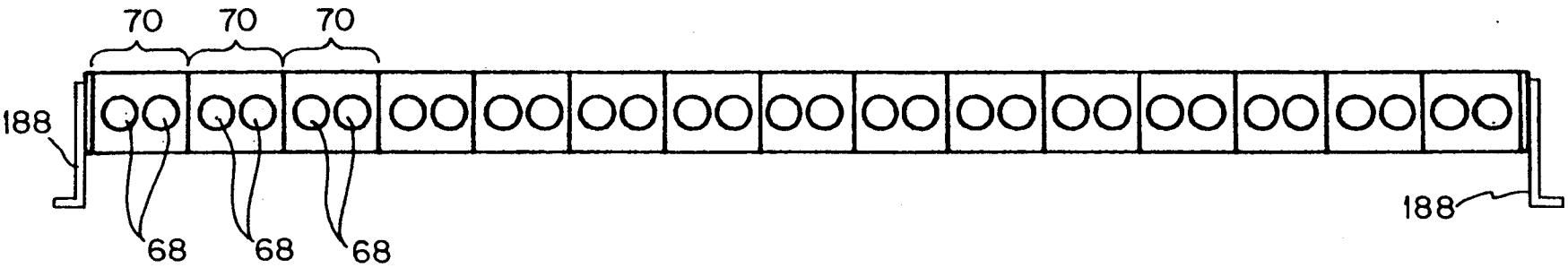
FIG. 12 is a rear view of the three strip light luminaires shown in FIG. 6.

FIGS. 11 and 1 illustrate three luminaire systems 50 assembled in a single strip light unit 192 which includes 15 lamp sets 70 or 30 lamp units 68. Strip light unit 192 is horizontally positioned resting on feet 188. Electrical wiring is positioned in three wiring channels 120 set in a continuous straight line.

The embodiment of the invention particularly described and disclosed herein is presented merely as an example of the invention. Other embodiments, forms, and modifications of the inventions coming within the proper scope and spirit of the appended claims will, of course, readily suggest themselves to those skilled in the art.

What is claimed is:

1. A multilamp strip light luminaire system for illuminating a portion of a stage for an audience, comprising, in combination, a housing having opposed front and rear walls, opposed first and second walls, and opposed side walls forming a rectangular compartment, said housing having front and rear sides associated with said front and rear walls, said front wall defining a lamp port, lamp means positioned in said compartment including at least one lamp having a light beam directed at said lamp port for illuminating the portion of the stage, said lamp means including a dichroic reflector for passing infrared light and accompanying heat through said reflector away from said front side of said housing toward said back side of said housing, electrical circuit means for supplying electrical power to said lamp means from a source of electrical power, said electrical circuit means including electrical wiring mounted in said compartment connected to said lamp means, vent means located at said first and second walls for passing heat generated by said at least one lamp within said housing to the atmosphere, rear vent means located at said rear wall of said housing for passing heat passed by said at least one lamp toward said back side of said housing from said housing to the atmosphere, baffle means within said housing for blocking passage of light leaking from said at least one lamp to said rear vent means, and, channel means formed in said housing for containing a portion of said electrical wiring whereby said electrical wiring is substantially isolated from the heat generated in said housing by said lamp, said housing defining an entrance port at said rear wall of said housing and said electrical circuit means further including an electrical power cord connected to said electrical wiring at said entrance port and to the source of electrical power, and further including inner wall means in said housing for forming said channel, said channel having a channel port proximate to said lamp means, said channel extending between said channel port and said entrance port, said electrical wires extending from said lamp means through said channel port and through said wiring channel to said entrance port.

2. The strip light system according to claim 1, wherein said rear wall includes a rear wall outer surface, said system further including fin means extending outwardly from said rear wall outer surface for passing heat contained in said rear wall to the atmosphere.

3. The strip light system according to claim 2, wherein said rear wall further includes a rear wall inner surface proximate to said fin means, said system further including heat absorbing, non-reflective paint on said rear wall inner surface.

4. The strip light system according to claim 1, wherein said rear wall includes a rear wall outer surface, said system further including fin means extending outwardly from said rear wall outer surface for passing heat contained in said rear wall to the atmosphere.

5. The strip light system according to claim 4, wherein said rear wall further includes a rear wall inner surface proximate to said fin means, said system further including heat absorbing, non-reflective paint on said rear wall inner surface.

6. The strip light system according to claim 1, further including lamp door means positioned in association with said top wall for providing access to said lamp means.

7. The strip light system according to claim 6, wherein said lamp door means includes said top wall defining a lamp access aperture and a door for covering said lamp access door, a hinge connected to said lamp door and to said top wall extending between said opposed side walls, and a toggle latch movable between loaded and unloaded modes, said lamp door being rotatable along said hinge between open and closed positions, wherein in said closed position said lamp door covers said lamp access aperture with said toggle latch being in said unloaded mode and wherein in said open position said lamp door said lamp door is positioned away from said lamp access aperture with said toggle latch being in said locking mode.

8. The strip light system according to claim 1, further including light treatment means positioned across said lamp port for providing variation in the color, intensity, or diffusiveness or a combination thereof of the light beams from said lamp.

9. The strip light system according to claim 8, wherein said filter means includes at least one filter and at least one filter holder for holding said at least one filter, and wherein said front wall of said housing forms recesses for holding said at least one filter holder.

10. The strip light system according to claim 9, wherein said at least one filter and said at least one filter holder is two filters held by two filter holders.

11. The strip light system according to claim 8, further including said first wall defining a filter slot opening at said filter means and a filter cover rotatably connected to said housing at said front wall, said filter cover being movable between closed and open positions, wherein is said closed position said filter cover overlies said filter slot and in said open position said filter cover is positioned away from said filter slot.

12. The strip light system according to claim 11, further including hinge means connected to said top wall and said filter cover, said filter cover being rotatable along said hinge means when being moved between said open and closed positions, and further including spring means having partly and fully biased modes, said filter cover being in said closed mode when said spring means is in said partly biased mode and being in said open position when said spring means is in said fully biased mode.

13. The strip light system according to claim 1, further including lampholder means mounted to said housing and positioned in said compartment for holding said lamp means in an operative position, said lampholder means including a lampholder connected to said housing and forming a lamp socket for holding said lamp in an operative mode, said lamp being movable between a mounted position in said lampsocket with said lamp being in an operative position and a demounted position with said lamp being removed from said lamp socket.

14. The strip light system according to claim 13, said lampholder means further including a pair of biasable holding wires which together with said lampholder forming said lamp socket, said biasable holding wires being movable between biased and unbiased modes, wherein in said biased mode said lamp is positioned in said socket or is completely removed from said socket, and in said unbiased mode said lamp is being removed from or being positioned in said socket.

15. The strip light system according to claim 14, and further including lamp releasing lever means connected to said lampholder for levering said lamp from said lamp socket.

16. The strip light system according to claim 1, wherein said at least one lamp includes a second lamp mounted in said compartment adjacent to and in the same manner as said at least one lamp and also connected to said electrical wiring, said at least one lamp and said at second lamp being electrically connected in series.

17. The strip light system according to claim 16, wherein said at least one lamp and said second lamp electrically connected comprise one lamp set, said system including a plurality of said lamp sets and said front wall defines one of said lamp ports for each lamp set.

18. The strip light system according to claim 17, further including separate light treatment means positioned across each said lamp port for providing variation in the color, intensity, or diffusiveness or a combination thereof of the light beams from said lamp sets.

19. The strip lighting system according to claim 18, further including a support wall spaced from and lateral to said front wall and extending between said first and second walls and between said end walls, said support wall defining a circular aperture in front of each said lamp, and still further including a plurality of spaced separating walls between and lateral to said end walls and extending between said first and second walls and between said front wall and said support wall, said separating walls being positioned between said plurality of lamp sets and thus forming a plurality of subcompartments aligned with said plurality of lamp sets so that each subcompartment passes light from one said lamp set through one of said plurality of lamp ports, whereby subcompartments are isolated from one another so as to separate different different colored lights emanating from adjacent subcompartments.

20. The strip lighting system according to claim 19, further including a mounting wall positioned adjacent between said end walls adjacent to said support wall, and a safety member held in position between said mounting wall and said support wall in front of each said lamp.

21. The strip light system according to claim 17, wherein said electrical wiring includes a first electrical wiring portion extending between said entrance port and said power cable and a second electrical wiring portion extending from said plurality of lamp sets to said first electrical wiring portion, said second wiring portion being connected in series and being connected in a plurality of parallel connections with said first electrical wiring portion.

22. The strip light system according to claim 21, further including indicator lamp means connected in series with said second electrical electrical wiring portion, said indicator lamp means including an indicator lamp positioned at said rear wall for signaling failure of said at least one lamp.

23. A multilamp strip light luminaire system for illuminating a portion of a stage for an audience, comprising, in combination, a housing having opposed front and rear walls, opposed first and second walls, and opposed side walls forming a rectangular compartment, said housing having front and rear sides associated with said front and rear walls, said front wall defining a lamp port, lamp means positioned in said compartment including at least one lamp having a light beam directed at said lamp port for illuminating the portion of the stage, said lamp means including a dichroic reflector for passing infrared light and accompanying heat through said reflector away from said front side of said housing toward said back side of said housing, electrical circuit means for supplying electrical power to said lamp means from a source of electrical power, said electrical circuit means including electrical wiring mounted in said compartment connected to said lamp means, vent means located at said first and second walls for passing heat generated by said at least one lamp within said housing to the atmosphere, rear vent means located at said rear wall of said housing for passing heat passed by said at least one lamp toward said back side of said housing from said housing to the atmosphere, baffle means within said housing coextensive with said rectangular compartment and positioned parallel to said front wall and between said spaced from said lamp and said rear wall for blocking passage of light leaking from said at least one lamp to said rear vent means, but permitting heat to pass from said lamp to said rear vent means, and, further including lampholder means mounted to said housing and positioned in said compartment for holding said lamp means in an operative position, said lampholder means including a lampholder connected to said housing and forming a lamp socket for holding said lamp in an operative mode, said lamp being movable between a mounted position in said lamp socket with said lamp being in an operative position and a demounted position with said lamp being removed from said lamp socket, and wherein said lampholder means further includes a pair of biasable holding wires which together with said lampholder form said lamp socket, said biasable holding wires being movable between biased and unbiased modes, wherein in said biased mode said lamp is positioned in said socket or is completely removed from said socket, and in said unbiased mode said lamp is being removed from or being positioned in said socket.

24. The strip light system according to claim 1, further including channel means formed in said housing for containing a portion of said electrical wiring, whereby said electrical wiring is substantially isolated from the heat generated in said housing by said lamp.

* * * * *